US006289516B1

(12) United States Patent
Motooka et al.

(10) Patent No.: US 6,289,516 B1
(45) Date of Patent: Sep. 18, 2001

(54) BASEBALL GLOVE

(75) Inventors: Ken Motooka, Hyogo; Kazuhiro Kume, Osaka, both of (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/564,038

(22) Filed: May 4, 2000

(30) Foreign Application Priority Data

May 13, 1999 (WO) ..... PCT/JP99/02482
Sep. 27, 1999 (JP) ..... 11-273035

(51) Int. Cl.[7] ..... A41D 13/08
(52) U.S. Cl. ..... 2/19
(58) Field of Search ..... 2/19; 1/16

(56) References Cited

U.S. PATENT DOCUMENTS 2,452,695 * 11/1948 Sonnett et al. .
3,602,915 9/1971 Collins .
3,721,996 3/1973 Nadorf .
4,227,263 * 10/1980 Zidele .
5,031,239 * 7/1991 Panichello et al. .
5,572,739 * 11/1996 Kolada et al. .
5,717,995 * 2/1998 Murai .
6,199,209 * 3/2001 Aoki .

FOREIGN PATENT DOCUMENTS 59-9668 3/1984 (JP) .
2-28278 2/1990 (JP) .
3-5471 1/1991 (JP) .
6-1171 1/1994 (JP) .
8-196681 * 8/1996 (JP) .
9-285588 * 11/1997 (JP) .
WO98/35730 8/1998 (WO) .

* cited by examiner

*Primary Examiner*—Rodney M. Lindsey
(74) *Attorney, Agent, or Firm*—McDermott, Will & Emery

(57) ABSTRACT

A baseball glove includes a thumb stall to receive a thumb. An incision is provided at the back leather of the thumb stall and the tip portion of the thumb is allowed to stick out from the incision on the back leather and the knuckle of the thumb is covered with back leather.

16 Claims, 16 Drawing Sheets

BASEBALL GLOVE

BACKGROUND OF THE INVENTION

1. Field of the Invention

The present invention relates to an implement to catch a baseball (hereinafter simply as "glove"), and more particularly to the structure of a thumb stall of a glove.

2. Description of the Background Art

As shown in FIGS. 15A to 15D, a conventional baseball glove is formed by sewing together a ball receiving front leather 16 having five approximately finger-shaped portions, and a back leather 15 having a plurality of leather parts forming five finger stalls. The peripheries of ball receiving front leather 16 and back leather 15 are sewed except for the part to insert a hand such that both the grain sides form the inside, and then it is turned inside out so that the grain sides come outside. This forms the front member.

Then, a palm leather 18 having a smaller size than the front member and five approximately finger-shaped portions and a back leather 17 having a plurality of leather parts to form five finger stalls are sewed together except for the opening to insert a hand such that both grain sides also form the inside. This forms the back member.

At various crucial points of the front member, a padding of felt and other shock absorbers are inserted or wax is applied, followed by impregnation with oil, then the back member is inserted, and then the hand inserting openings of the front and back members are combined with leather laces.

Then, a separately formed ball receiving portion (web portion) is attached between the thumb stall and the index finger stall also with leather laces, and a baseball glove is completed.

When you catch a ball, you grab the ball held between the thumb and other fingers inserted in the stalls.

The opening of the thumb stall of the back member is large and slippery, and Japanese Utility Model Publication Nos.59-9668 and 6-1171 are directed to improvements to this state.

The documents disclose a ling shaped thumb stopper to secure a thumb at the inserting opening of the finger stalls of the back member. Thus, the force of the thumb can be relatively efficiently transmitted. FIG. 16 shows an example of a conventional baseball glove having a thumb stopper 19.

The baseball glove having thumb stopper 19 described above however suffers from the following disadvantage. Since the shape and length of fingers are different among players, and therefore the thumb stopper often does not fit the shape of a player's thumb. As a result, the player often finds the glove disagreeable.

In addition, for children with not so strong force and a weak grip, simply securing a thumb at the thumb stopper is not enough for them to flex the baseball glove, which impedes sure catching, because the baseball glove cannot be completely closed in catching.

SUMMARY OF THE INVENTION

The present invention is directed to a solution to the above-described problem, and it is an object of the present invention to provide a baseball glove which enables sure catch, with which a player's thumb inserted in the thumb stall can be readily secured in the flexing direction of the glove, so that even a child with weak grip can completely close the glove in catching a ball without much changing the work involved in the manufacture from the conventional case.

A baseball glove according to the present invention includes a thumb stall to insert a thumb, and there is provided an incision (cut) at the back leather portion of the thumb stall to let the tip of the thumb stick out on the back leather as well as to cover the knuckle of the thumb with the back leather. What is referred to as baseball herein includes softball. The baseball glove herein includes a catcher mitt and a first mitt.

As described above, by providing an incision to let the tip portion of the thumb stick out from the back leather at the back leather portion of the thumb stall portion, the baseball glove can be closed with smaller force than the case of the conventional glove. The reason will be now described in conjunction with FIGS. 13 and 14. As shown, force applied to each finger when the baseball glove according to the present invention used (see particularly the three rightmost squares on in FIG. 13) is smaller than force applied on each finger using a conventional glove (see particularly the rightmost three squares in FIG. 14). More specifically, according to the present invention, the baseball glove can be flexed with smaller force than the conventional glove.

The tip portion refers to a portion positioned on the tip side of the thumb through which force can be applied upon the back leather. The tip portion includes a part for example from the first joint to tip of the thumb.

The inventors found that the part from the first joint to the tip of the thumb is very much used when the glove according to the present invention is closed. Thus, by letting the part from the vicinity of the first joint to the tip stick out on the back leather, the tip portion of the thumb can be freely moved without the constraint of the thumb stall, and excess force is not necessary in order to apply force upon the thumb stall. As a result, the glove can be closed with smaller force.

The part closer to the knuckle side of the thumb rather than the first joint is preferably covered with the back leather.

Thus, the flexibility of the tip portion of the thumb can be secured while only the knuckle part of the thumb can be fixed at a desired position. As a result, stable force can be applied from the thumb to the thumb stall, so that the force from the thumb can be surely and effectively transmitted to the glove.

The above-described incision preferably has a large length. The length of the incision may be for example not less than the width of the central part along the lengthwise direction of the thumb stall and not more than the maximum width of the thumb stall.

When the glove is closed, a part of the back leather positioned closer to the tip side of the thumb stall with respect to the incision is pressed by the thumb to move toward the inner side of the glove. Meanwhile, a part of the back leather positioned closer to a hand inserting portion with respect to the incision does not move. Thus, if the length of the incision is large, a great step can be formed as shown in FIG. 4, for example, between the parts of the back leather positioned on the tip side and on the side of the hand inserting portion when the glove is closed. More specifically, the restricting force of the part of the back leather on the side of the hand inserting portion upon the part of the back leather on the tip side can be reduced when the glove is closed. Thus, resistance generated when the part of the back leather positioned on the tip side is moved inside can be reduced, so that the force necessary for closing the glove can be reduced.

If the length of the incision is thus extended, the glove can flexibly adapt to users with different hand sizes. More specifically, the thumb is freely allowed to stick out from any positions of the incision, so that force can be applied upon the back leather at a position adapted to the shape or size of the user's hand.

The incision preferably extends from the outer end of the thumb stall toward the inner side.

Thus, the length of the incision can be sufficiently long, and the above described effect can be provided.

A thumb protecting member to cover the tip portion sticking out on the back leather is preferably attached on the back leather.

The thumb on the back leather is covered by the thumb protection member, and therefore the thumb will not be injured by running into a runner. Also, the member virtually secures the thumb in a desired position such as a position easy for the user to apply force and restrains the thumb from move more than necessary, so that the force of the thumb is surely transmitted to the thumb stall.

The length of the above incision is preferably greater than the maximum width of the thumb protecting member.

Since the incision has sufficiently large length, in addition to the above described effect, the thumb can be readily inserted into a space defined by the thumb protecting member if the size and shape of the user's hand vary.

The thumb protecting member is preferably provided closer to the inner side with respect to central line along the lengthwise direction of the thumb stall.

The manufactured glove is significantly larger than a hand so as to catch a ball in a wide range. Meanwhile, a ball once caught had better be grasped with the hand in order to prevent the ball from falling. Thus, by providing the thumb protecting member at the above-described position, a ball can be not only surely caught at the pocket portion but also the caught ball can be firmly grasped with the hand. As a result, a ball can be prevented from falling during a play in which the user touches a runner with the glove in a rough manner.

The tip end of the thumb protecting member along the lengthwise direction is preferably positioned on the inner side with respect to the central line of the thumb stall. In this case, thumb protecting member extends in a direction oblique relative to the central line of the thumb stall at a prescribed angle toward the web portion of the glove.

Since the thumb protecting member thus extends in the abovedescribed direction, the thumb may be guided toward the side of the web portion, so that a caught ball can be surely grasped.

The tip end of the thumb protecting member is preferably released from the back leather.

If the tip end of the thumb protecting member is fixed to the back leather, the tip end could serve as resistance against the movement of the thumb protecting member together with the back leather toward the inner side of the glove. Therefore, the tip end of the thumb protecting member is released from the back leather in order to remove such resistance. This could also contribute to reduction in the force necessary to close the glove.

The end portion of the thumb protecting member on the side of the hand inserting portion preferably covers the incision.

Since the lower end of the thumb protecting member is thus extended, the backside of the thumb can be prevented from being exposed when the thumb is bent during a touch play for example. Thus, impact in a play such as touch play can be alleviated.

A space to store the tip portion of the thumb is preferably formed by the back leather and the thumb protecting member, as the tip end portion is still capable of moving.

Thus, the thumb can be freely moved in the space, and desired force can be applied upon the back leather.

A slip stopper member is preferably attached on the part of the back leather upon which the palm side of the thumb sticking out from the incision abuts.

When the glove is closed, the tip portion of the thumb mainly presses the thumb stall toward the inner side of the glove. Therefore, it is preferable that the tip portion does not slip on the thumb stall. Thus, by attaching the slip stopper member as described above, the tip end portion can be restrained from slipping on the thumb stall and also the sense of touch can be improved. Thus, force from the thumb can be surely transmitted to the thumb stall.

The slip stopper member is preferably formed of embossed artificial leather or synthetic leather.

Thus, friction resistance can be increased between the tip portion of the thumb and the slip stopper member, so that the close contacted state between them can be improved. The use of artificial leather or synthetic leather can not only improve the friction resistance but also can prevent deformation as compared to the use of natural leather. As a result, a highly close contacted state can be maintained for a long period of time between the tip portion and the slip stopper member.

The end of the slip stopper member on the side of incision is secured to the back leather in a folded state so as to cover a part of the end of the back leather forming the incision.

Thus, the end of the slip stopper member and the thumb can be prevented from contacting and the slip stopper member can be prevented from coming off.

The baseball glove includes a hand inserting portion to insert a hand to the glove. The back leather of the thumb stall preferably includes a first back leather portion positioned closer to the tip end of the thumb stall with respect to the incision, and a second back leather portion positioned closer to the hand inserting portion. The first and second back leather portions have first and second folded portions, respectively, and the incision is formed between the first and second folded portions. The portions adjacent to the first and second folded portions in the first and second back leather portions are placed upon (overlapped) each other and sewed together.

Since the back leather of the thumb stall has the first and second back leather portions as described above, the incision can be formed simply by selectively sewing them together. More specifically, for example, respective one ends of the first and second back leather are selectively folded to form first and second folded portions, and then the incision may be readily formed simply by stacking the portions adjacent to the first and second folded portions one another and sewing them together. Thus, the incision can be easily formed. In addition, since the adjacent portions are placed upon each other and sewed together, a difference in height may be provided between the first and second folded portions, so that a slight step may be formed at the incision from the start of use. Particularly, by placing the second back leather on the first back leather, the first folded portion can be positioned at a lower level than the second folded portion. Therefore, the thumb can easily stick out from the incision on the back leather. Furthermore, the first and second back leather portions are placed upon each other and sewed together, so that the strength of the thus sewed part (overlapping part) can be improved.

A member extending over the incision in a direction crossing the direction in which the incision extends to restrict the end of the incision from ripping is preferably provided on the back leather.

Thus, the end of the incision can be restricted from ripping.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Baseball gloves which mainly let an index finger stick out from the back leather are disclosed by U.S. Pat. Nos. 3,602,915 and 3,721,996 before the present invention.

According to these inventions, however, any of fingers other than a thumb sticks out from the back leather, rather than the thumb.

In addition, thus sticking a finger out from the back leather is rather an element in fashion and does not provide any significant advantage.

Conversely, thus sticking out a finger could cause injury when the finger touches the ground in catching a grounder, or the player's finger could be spiked by a runner when the runner runs into the player, which is not desirable.

According to the present invention, however, if a thumb inserted in the thumb stall sticks out from the back leather, the force of the thumb may be surely transmitted to the thumb stall, so that the baseball glove can be easily flexed and therefore even a child with weak grip can completely close the glove to surely catch a ball.

Figure 13:
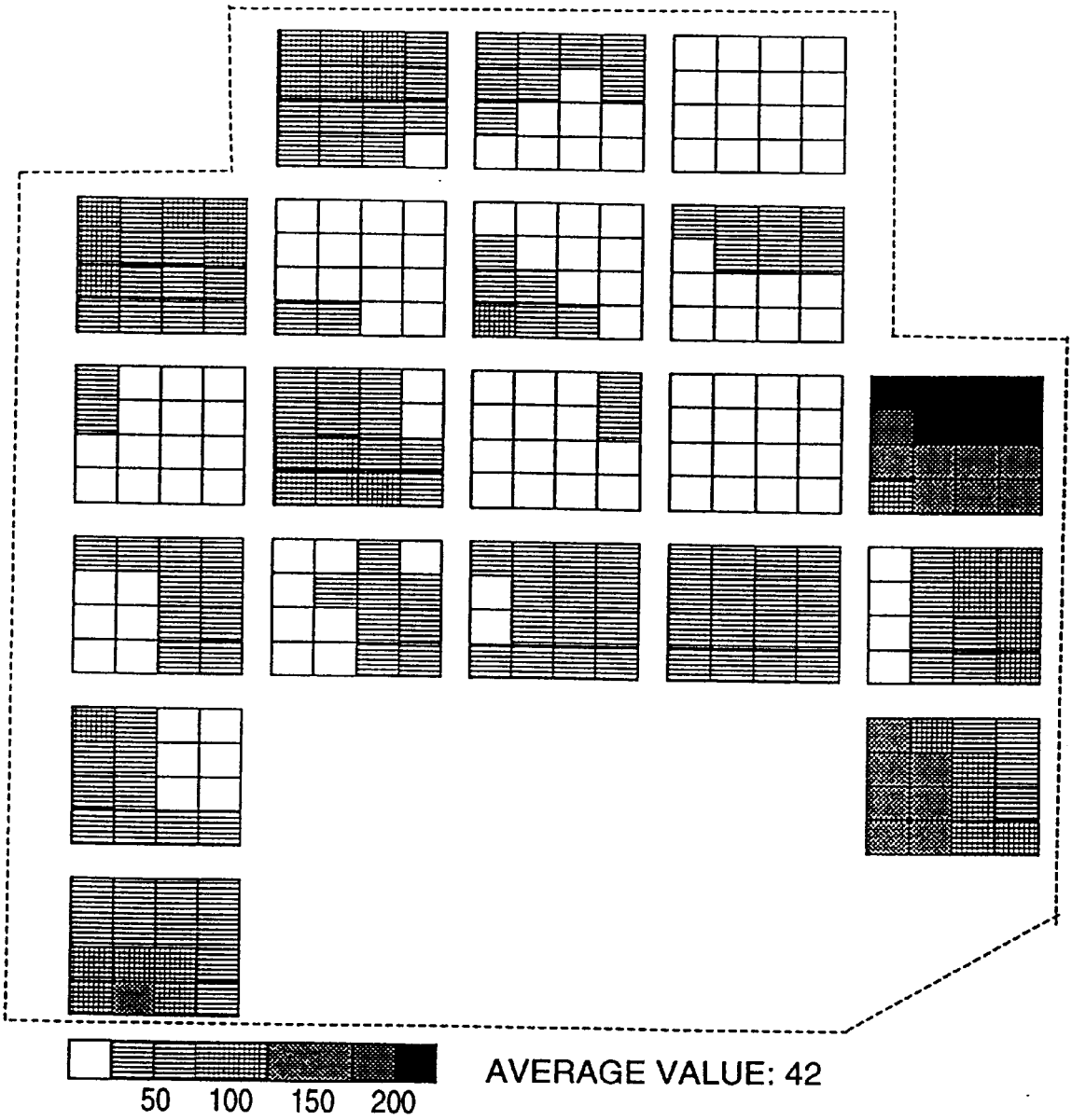
FIG. 13 shows force applied on each finger when a baseball glove having a thumb stall construction according to the present invention is flexed.

This will described by referring to FIGS. 13 and. 14.

FIGS. 13 and. 14 show results of measuring the force of each finger necessary at the time of flexing (closing) a baseball glove having a structure according to the present invention and a baseball glove having a conventional thumb stall construction, using the glove scan system by Nitta Corporation.

Figure 14:
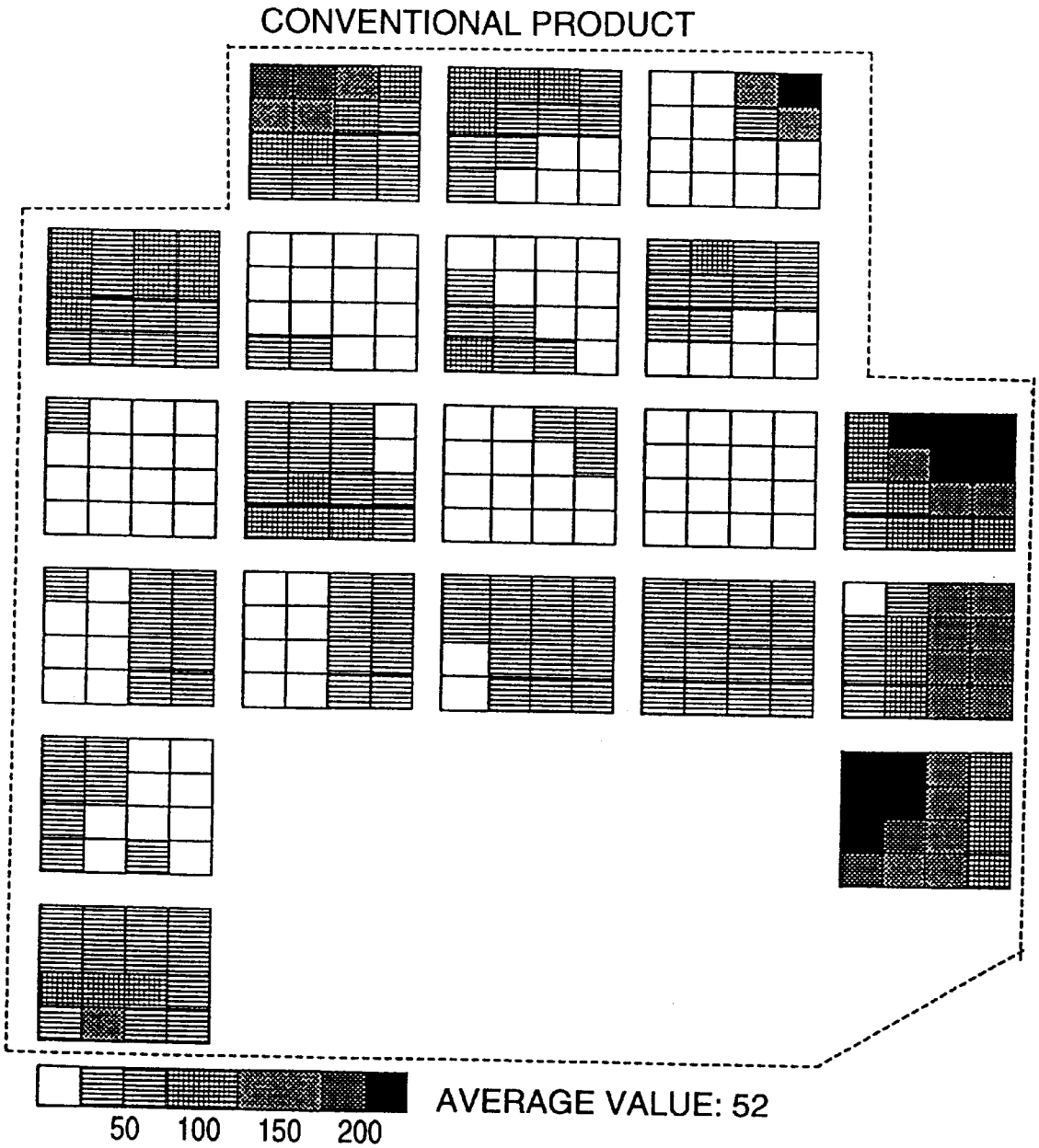
FIG. 14 shows force applied on each finger when a baseball glove having a conventional finger stall construction is flexed.
Figure 15A:
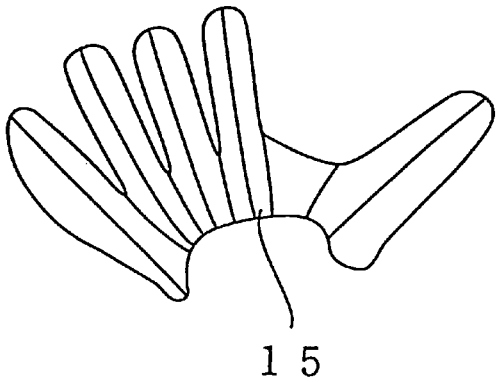
FIG. 15A PRIOR ART
FIGS. 15A to 15D are views of parts of a baseball glove.
Figure 15C:
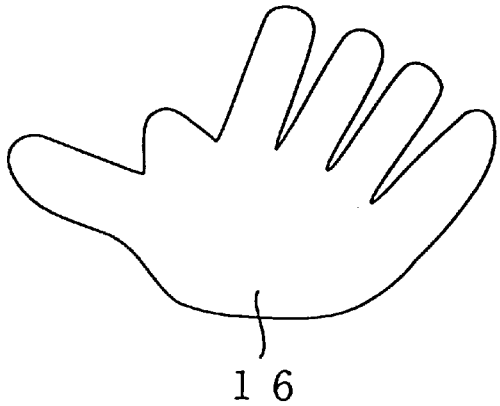
FIG. 15C PRIOR ART
Figure 15B:
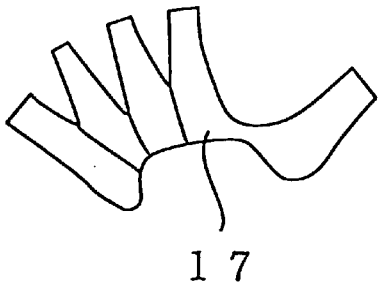
FIG. 15B PRIOR ART
Figure 15D:
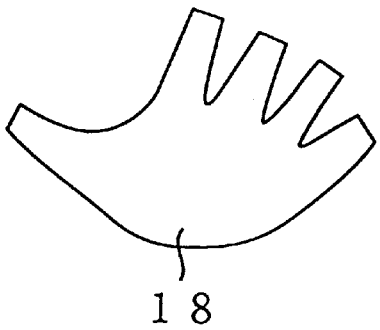
FIG. 15D PRIOR ART
Figure 16:
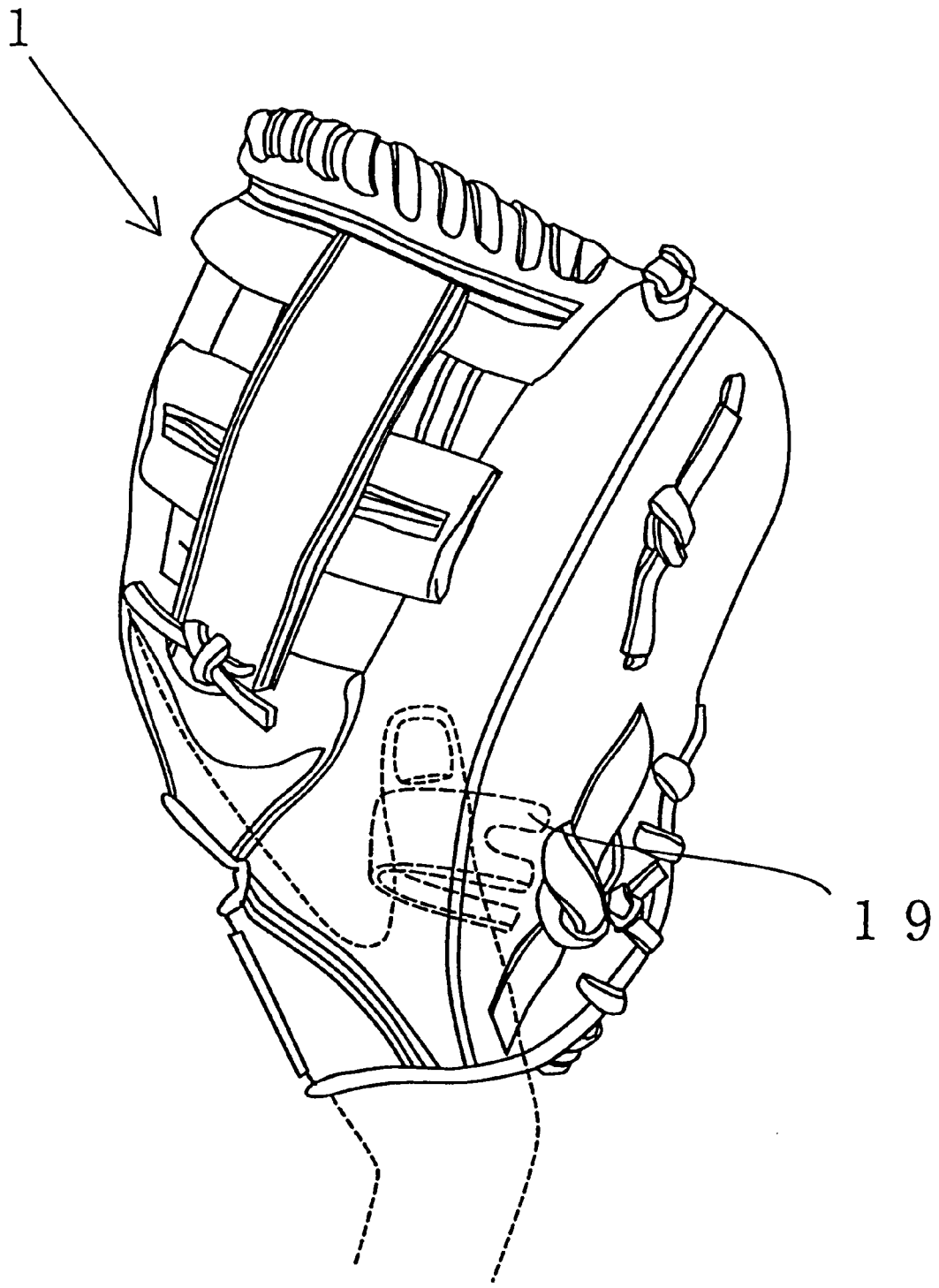
FIG. 16 PRIOR ART
FIG. 16 is a front view of a conventional baseball glove having a thumb stopper.

FIG. 13 gives the result of measurement for the glove according to the present invention, while FIG. 14 gives the result of measurement for the conventional baseball glove.

How to see these figures will be described. Both figures represent data on left hands (a right-handed person wear a glove on the left hand), and in the figures, data on the thumb, index finger, middle finger, third finger and little finger is given from the right to the left, and data on each finger from the palm to the tip is given from the bottom to the top.

More specifically, in each of the figures, five rows of a plurality of squares arranged in the horizontal direction represent force applied on the fingers from the tips toward the knuckles. More specifically, it may be assumed that the five rows of a plurality of squares substantially correspond to the fingers of a left hand. Force applied to the palm side of the fingers is shown shaded with different kinds of lines. As the shade becomes dense, the force applied is higher, and a thin transverse line corresponds to small force.

In the conventional baseball glove, as can be seen from FIG. 14, force is applied substantially entirely on the fingers, and large force is applied particularly on the entire thumb and on the tip of index finger, middle finger and third finger. The data shows that large force is required at the thumb and the tip of the other fingers to flex the baseball glove.

Meanwhile, in the baseball glove according to the present invention, as shown in FIG. 13, less force is generally applied than the conventional product shown in FIG. 14. (The average of the force applied on all the fingers is 52 $g/cm^2$ for the conventional product and 42 $g/cm^2$ for the present glove.) The force is partly not applied on the index finger and middle finger, and the force applied on the entire thumb is small as well. This shows that the baseball glove can be flexed with smaller force.

According to the present invention, particularly large force is applied at the tip portion of the thumb. This shows that large force can be applied on the tip portion of the thumb unlike the conventional product with the thumb stopper. Note that the same result should be provided for the right hand.

Figure 1:
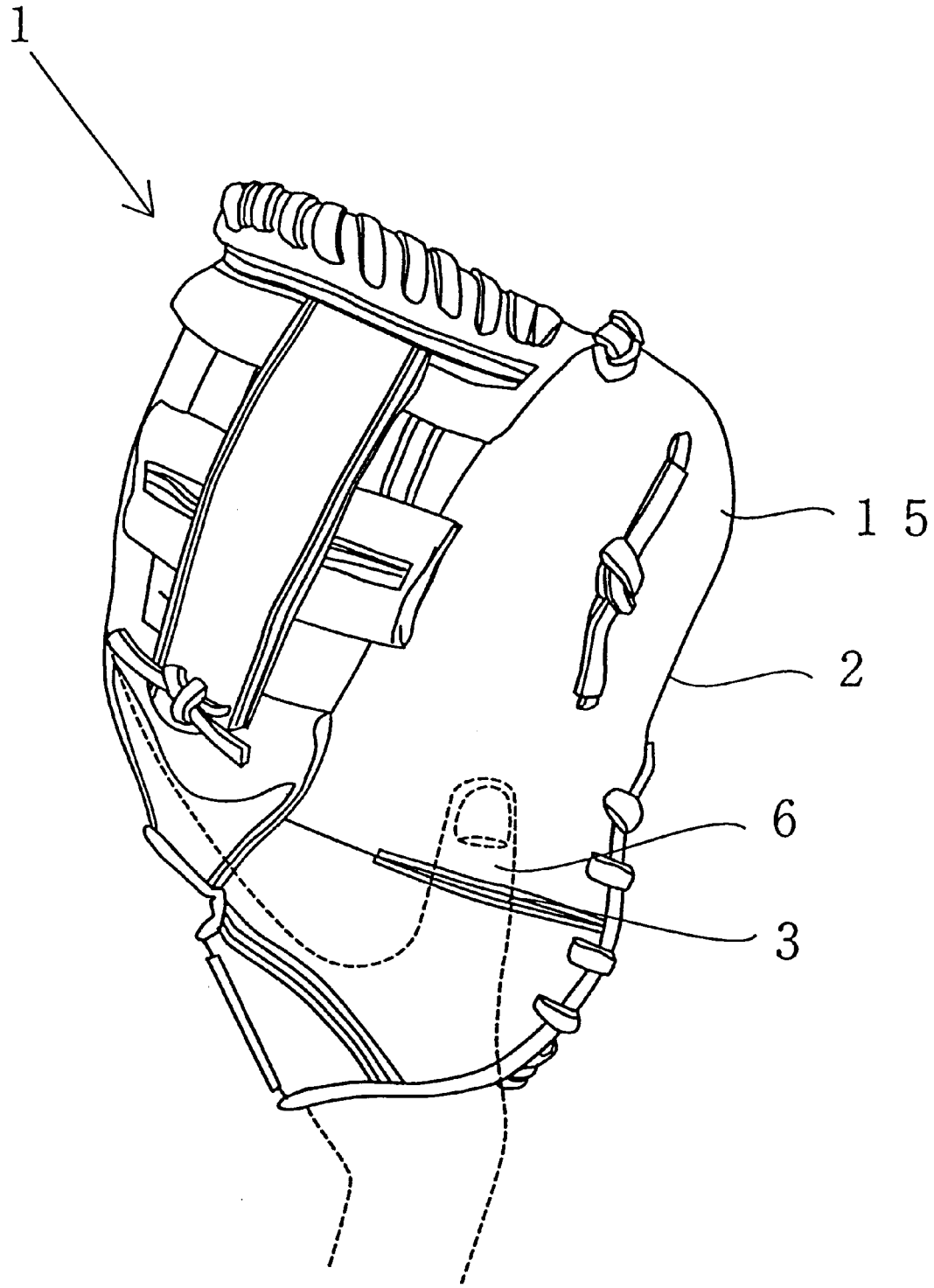
FIG. 1 is a front view of a baseball glove according to the present invention, viewed from the back leather side of the thumb stall.

Referring to FIGS. 1 to 10B, the shape of the baseball glove according to the present invention will be more specifically described. FIG. 1 is a view of baseball glove 1 of the invention from the side of the back leather 15 of thumb stall 2.

Back leather 15 is provided with an incision 3 to let the tip portion of thumb 6 stick out on back leather 15 when thumb 6 is inserted in thumb stall 2. More specifically, as shown in FIG. 1, the part from the first joint of thumb 6 to the tip is allowed to stick out on back leather 15.

The inventors found that the part from the first joint to tip of thumb 6 is very much used when the glove according to the present invention is closed. Thus, by letting the part from the vicinity of the first joint to the tip stick out on the back leather 15, the tip portion of thumb 6 can be freely moved without the constraint of thumb stall 2, and excess force is not necessary in order to apply force upon thumb stall 2. As a result, the glove can be closed with smaller force.

Meanwhile, the part of thumb 6 closer to the knuckle of thumb 6 than the first joint is covered with back leather 15. Therefore, while the freedom of the tip portion is secured, only the knuckle portion of thumb 6 can be fixed by back leather 15. As a result, stable force can be applied from thumb 6 to thumb stall 2.

In the embodiment shown in FIG. 1, incision 3 is in a slit shape. However, as long as thumb 6 may stick out from back leather 5, the shape of incision 3 may be arbitrarily selected.

Since only slit-shaped incision 3 is provided at a position of back leather 15 corresponding to thumb stall 2 as described above, the work required in the manufacture is almost the same as that of the conventional product, which will be described later.

Figure 2:
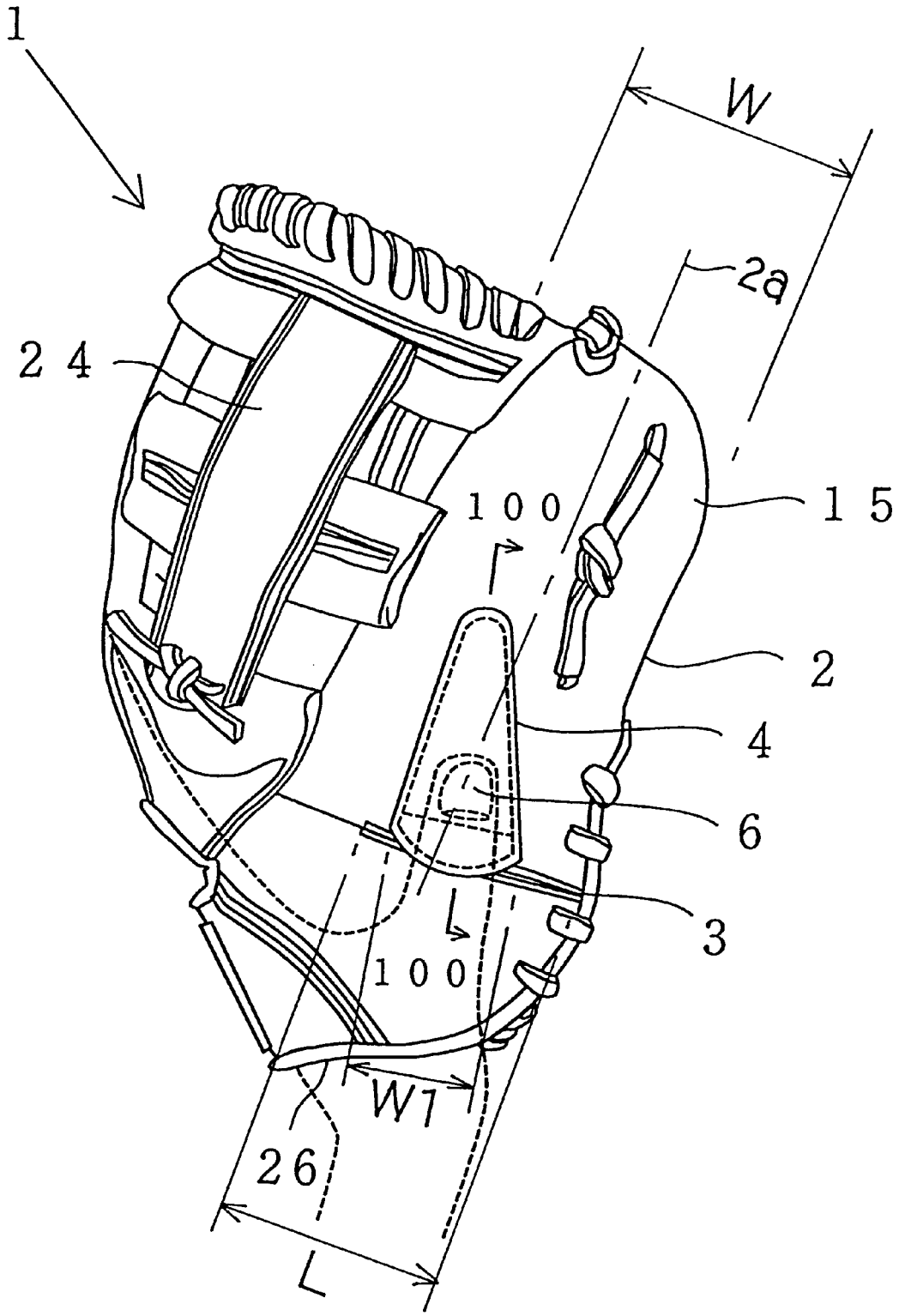
FIG. 2 is a front view of another embodiment of the present invention.

Since additional parts are not necessary, the manufacture is easy and the manufacturing cost is not extremely higher. FIG. 2 is a view of an embodiment of a baseball glove 1 in FIG. 1 having a thumb protection member 4 at back leather 15 to cover thumb 6 sticking out from back leather 15.

In this embodiment, thumb 6 sticking out from back leather 15 is covered by thumb protection member 4, a player will not be injured even if he is spiked by a runner.

Figure 4:
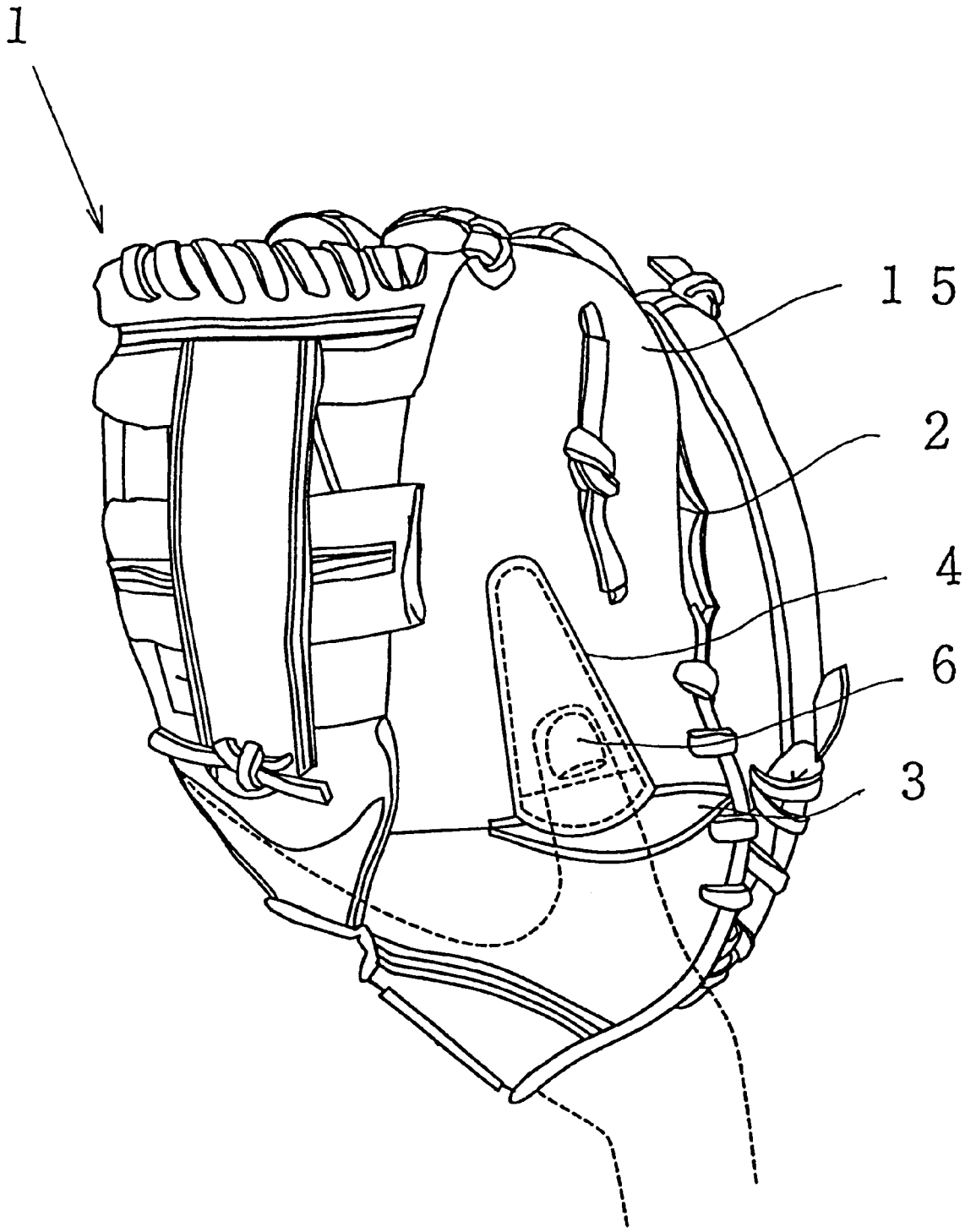
FIG. 4 is a front view of yet another embodiment of the present invention.

Also as shown in FIG. 2, incision 3 preferably has a large length L. The length L of incision 3 is not less than the width W of the central portion along the length wise direction of thumb stall 2 and not more than the maximum width W of thumb stall 2. By thus securing large length L for incision 3, a large step can be formed at incision 3 as shown in FIG. 4 when glove 1 is closed.

More specifically, the restraining force of the part of back leather 15 positioned on the side of hand inserting portion 26 upon the part of back leather 15 positioned on the tip end side of thumb stall 2 can be reduced, when glove 1 is closed. Thus, the resistance generated when the part of back leather 15 positioned on the tip end side is moved to the inner side of glove 1 (in the direction of closing glove 1) can be reduced, so that the force necessary to close glove 1 can be reduced.

Furthermore, since the length L of incision 3 is large, the glove can be adapted to users hands of different shapes and sizes. More specifically, thumb 6 is allowed to freely stick out from any position of incision 3, and force may be applied upon back leather 15 at a position adapted to the shape and size of the user's hand.

As shown in FIGS. 1 and 2, incision 3 extends from the outer end of thumb stall 2 (the right end in FIGS. 1 and 2) to the inner side. Thus, the length L of incision 3 may be made long.

Thumb protection member 4 serves to secure thumb 6 at a desired position (a position easy to apply force to thumb stall 2, for example) and restrain thumb 6 from moving more than necessary to surely transmit the force of thumb 6 to thumb stall 2. The periphery of thumb protection member 4 is selectively sewed to back leather 15. A space to store the tip portion of thumb 6 while the tip portion is allowed to move freely is defined by thumb protection member 4 and back leather 15.

The length L of incision 3 is preferably greater than the maximum width W1 of thumb protecting member 4. Thus, thumb 6 may be readily inserted to thumb protecting member 4 if the size and shape of the user's hand varies. As shown in FIG. 2, if the lower end of thumb protecting member 4 is expanded, thumb 6 may be further readily inserted to thumb protecting member 4.

Thumb protecting member 4 is positioned closer to the inner side with respect to the central line 2*a* along the lengthwise direction of thumb stall 2. Thus, a ball can be not only surely caught at the pocket portion but also surely grasped by the hand and will not fall even in the rough play such as touch play.

As shown in FIG. 2, the tip end of thumb protecting member 4 along the lengthwise direction is positioned closer to the inner side with respect to the central line 2*a* of thumb stall 2 (on the side of web portion 24). Thumb protecting member 4 preferably extends in a direction oblique by a prescribed angle (for example, in the range from 5° to 30°, more preferably from 15° to 20°) relative to the central line 2*a* of thumb stall 2 toward the side of the web portion 24 of glove 1. Thus, thumb 6 may be guided to the side of web portion 24, so that thumb 6 may be secured at a position easy for a hand to grasp a caught ball. As a result, the caught ball can be surely grasped by the hand.

The tip end of thumb protecting member 4 is sewed to back leather 15 in FIG. 2 but may be released from back leather 15.

The end of thumb protecting portion 4 on the side of hand inserting portion 26 covers incision 3 as shown in FIG. 2. By thus extending the lower end of thumb protecting member 4, the backside of thumb 6 can be prevented from being exposed, for example when thumb 6 is bent during a touch play. Thus, impact in the touch play can be alleviated.

Figure 3:
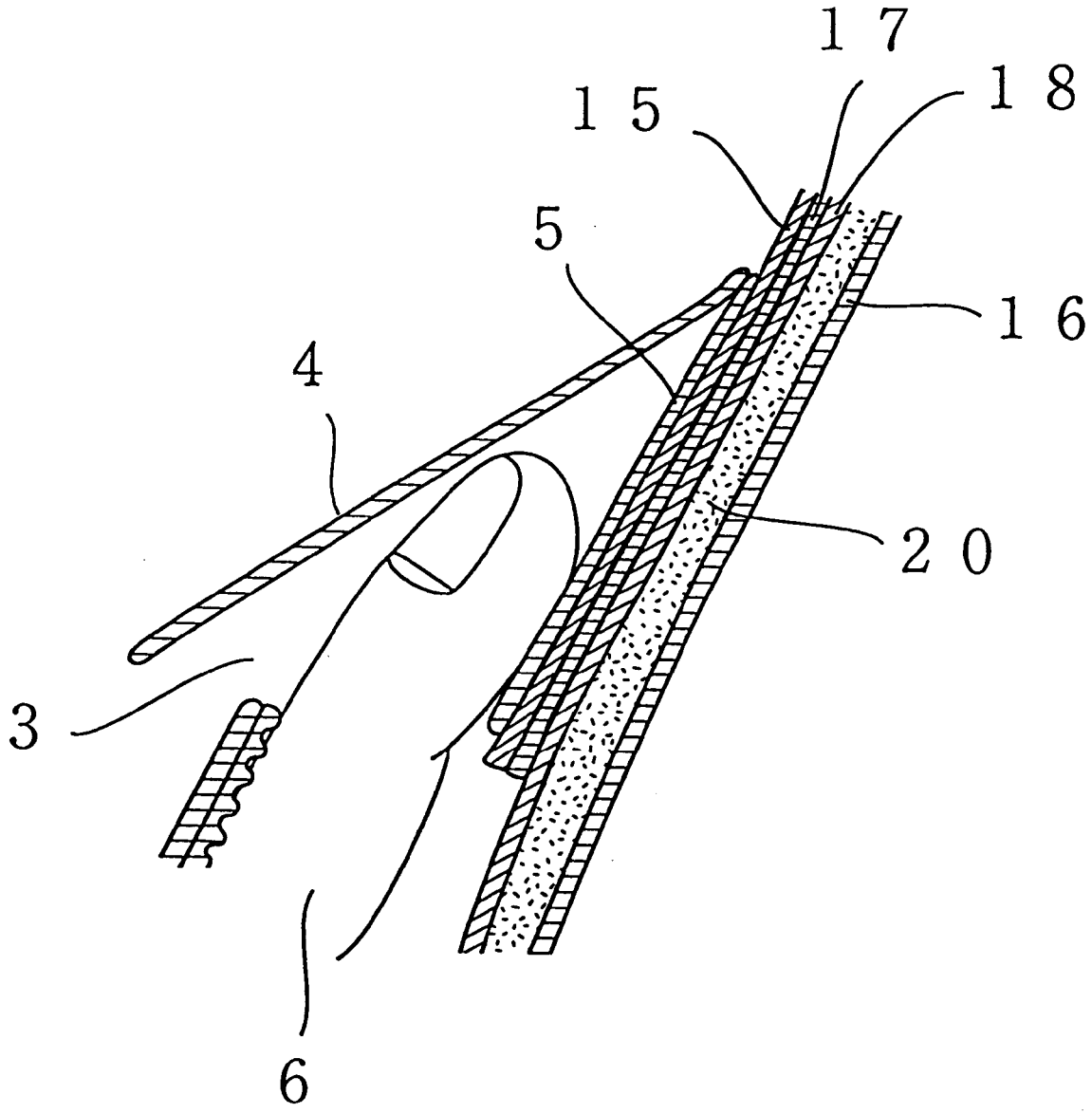
FIG. 3 is an end view along line 100—100 in FIG. 2.

FIG. 3 is an end view taken along 100—100 in FIG. 2.

In FIG. 3, a slip stopper member 5 is attached from the vicinity of incision 3 to the finger tip on back leather 15 against which the palm side of thumb 6 sticking out from back leather 15 abuts inside thumb protection member 4.

When the glove is closed, the tip portion of thumb 6 mainly presses thumb stall 2 toward the inner side of the glove. As a result, it is preferable that the tip portion does not slip on thumb stall 2. Therefore, slip stopper member 5 is provided as described above, so the user may have a good feel and the tip portion may be restrained from slipping on thumb stall 2. As a result, the force of thumb 6 may be surely transmitted to thumb stall 2.

Slip stopper member 5 is preferably formed of an embossed artificial leather or synthetic leather.

Thus, the friction resistance between the tip portion and slip stopper member 5 may be increased, so that the close contact between them may be improved. If slip stopper member 5 is provided with viscosity, the close contact may be further improved.

The use of the artificial leather or synthetic leather may not only improve the friction resistance as compared to the use of natural leather but also restrain deformation. As a result, a highly close contacted state between the tip portion and slip stopper member 5 may be maintained for a long period of time.

Note that in FIG. 3, reference numeral 16 represents a ball receiving surface, 17 a back leather, 18 a palm leather, and 20 a padding member.

In the embodiment shown in FIGS. 2 to 4, both thumb protection member 4 and slip stopper member 5 are provided, but only one of them may be provided as desired.

Figure 5:
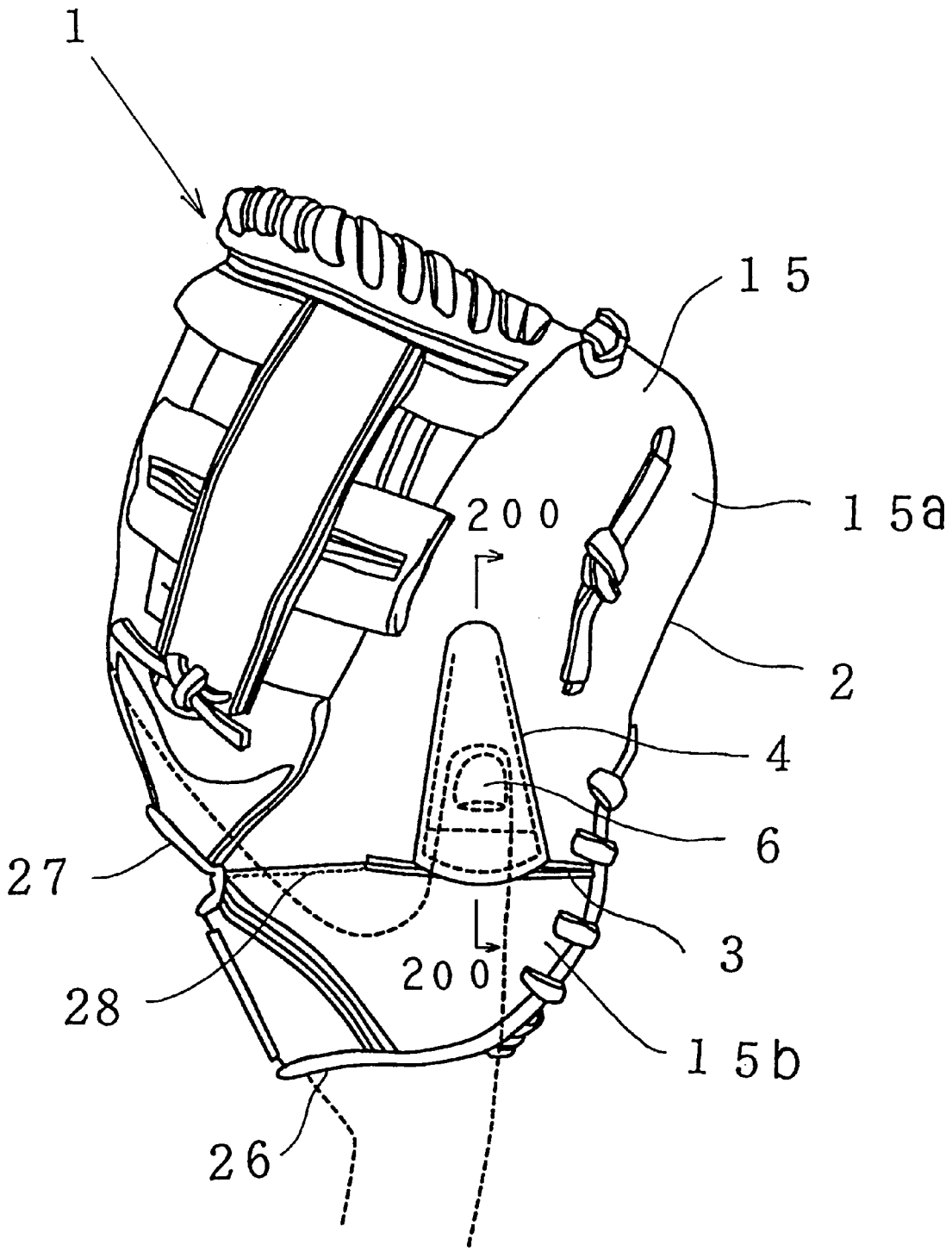
FIG. 5 is a front view of another embodiment of the present invention.
Figure 6:
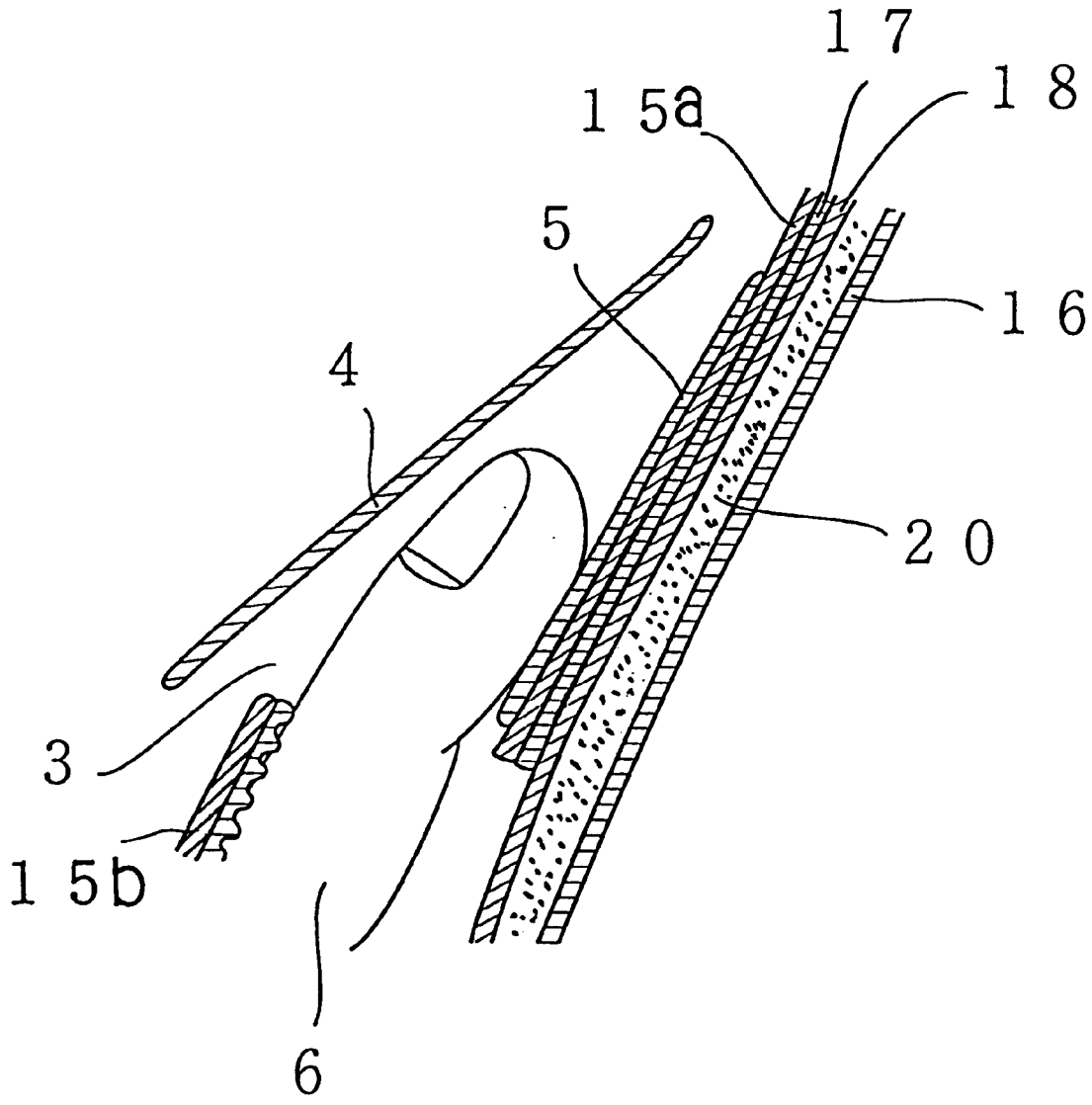
FIG. 6 is a cross sectional view taken along line 200—200 in FIG. 5.

Referring to FIGS. 5 and 6, another embodiment of the present invention will be now described.

As shown in FIG. 5, a glove 1 includes a first opening (hand inserting portion) 26 to insert a hand into glove and a second opening 27 to selectively expose the back of a hand. The back leather 15 of thumb stall 2 includes a first back leather portion 15*a* positioned on the tip end side of thumb stall 2 with respect to incision 3 and a second back leather portion 15*b* which is a separately provided member positioned on the side of hand inserting portion 26 with respect to incision 3. The tip portion of thumb 6 is allowed to stick out on first back leather portion 15*a* and the knuckle portion of thumb 6 is covered with second back leather portion 15*b*.

Incision 3 is formed between first and second back leather portions 15*a* and 15*b*, and first and second back leather portions 15*a* and 15*ba* positioned between incision 3 and second opening 27 are sewed with one another. This sewed part 28 and incision 3 are positioned on the same straight line, and both extend toward second opening 27.

Since the back leather 15 of thumb stall 2 has first and second back leather portions 15*a* and 15*b* as described above, incision 3 may be formed simply by selectively sewing these portions together. Thus, incision 3 may be readily formed.

Furthermore, since incision 3 extends toward second opening 27, the inner end portion of incision 3 (the left end portion in FIG. 5) may be positioned closer to the side of hand inserting portion 26 than the previously described embodiment. As a result, as shown in FIG. 5, incision 3 may be extended in a direction approximately perpendicular to the lengthwise direction of thumb 6, so that thumb 6 is more easily allowed to stick out from incision 3 than the previously described embodiment.

Furthermore, the tip end of thumb protecting member 4 is isolated from back leather 15. By thus releasing the tip end of thumb protecting member 4 from back leather 15, resistance generated when thumb protecting member 4 is moved together with back leather 15 toward the inner side of the glove may be reduced. This can also contribute to reduction in force necessary for closing glove 1. FIG. 6 is a cross sectional view taken along line 200—200 in FIG. 5.

Figure 7:
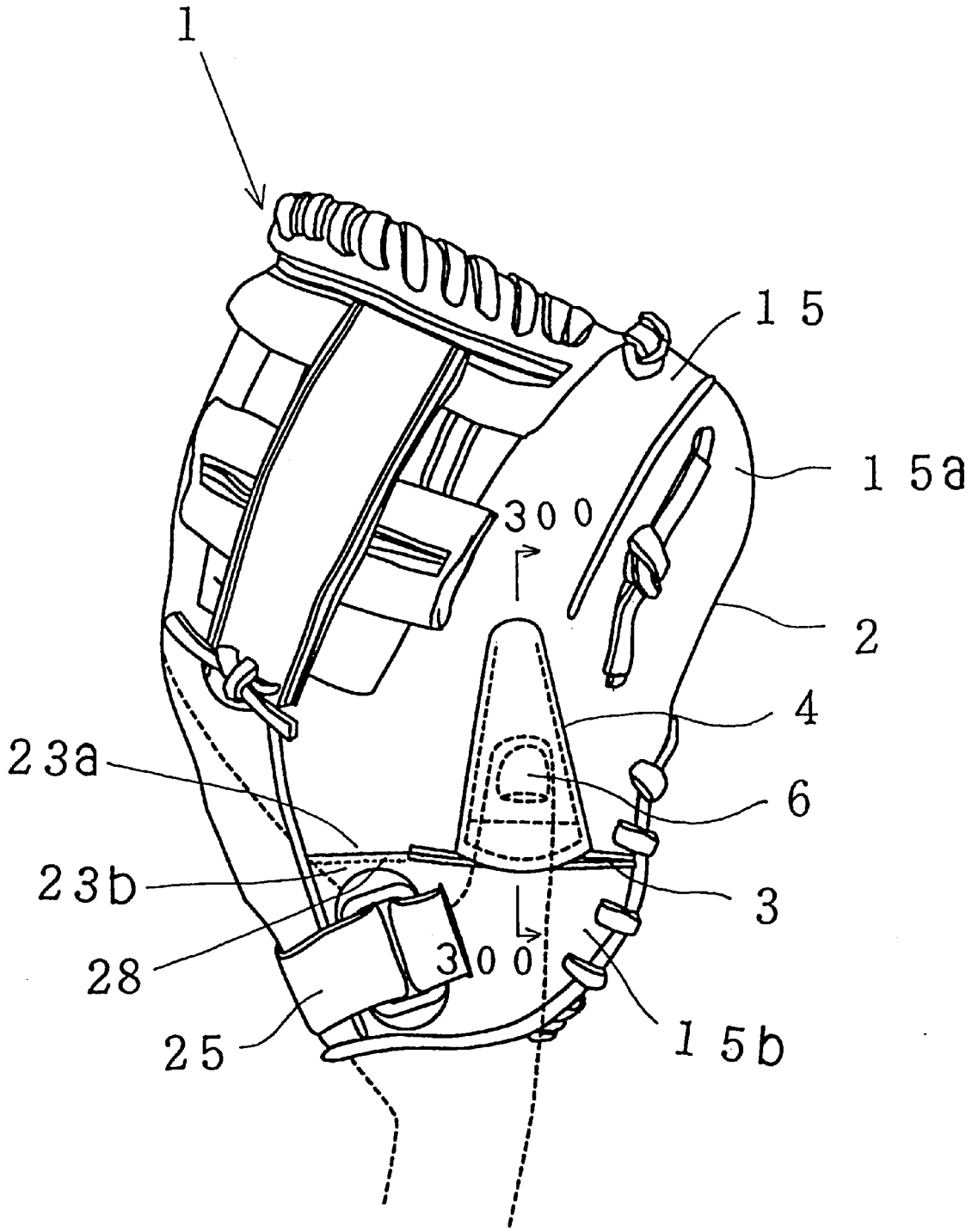
FIG. 7 is a front view of yet another embodiment of the present invention.
Figure 8:
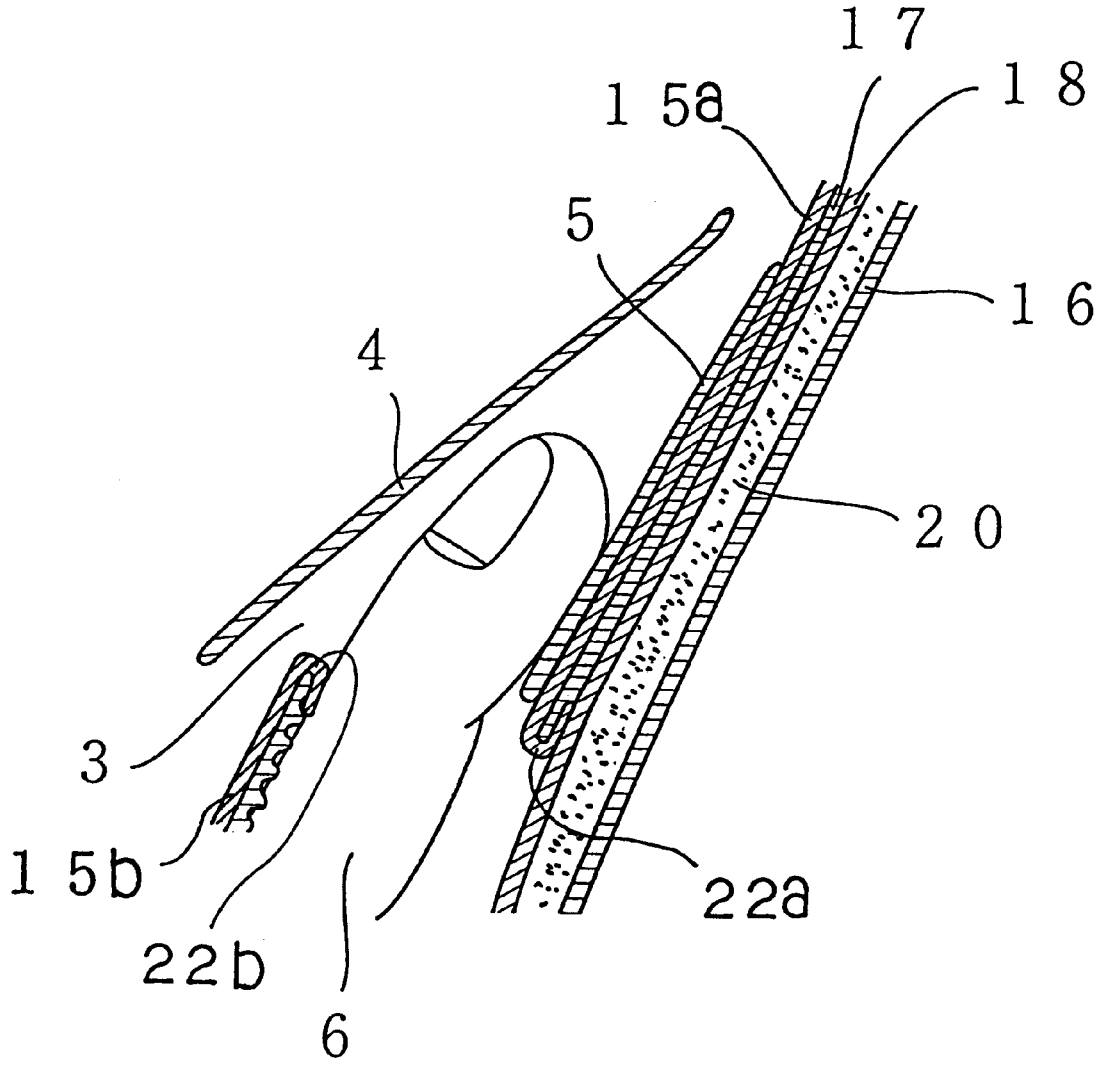
FIG. 8 is a cross sectional view taken along line 300—300 in FIG. 7.

Referring to FIGS. 7 to 10B, yet another embodiment of the present invention will be now described. According to this embodiment, the present invention is applied to a type of glove 1 having a fastening member (belt) 25 attached to the hand inserting portion of glove 1 to secure a hand to glove 1. FIG. 8 is a cross sectional view taken along line 300—300 in FIG. 7, and FIGS. 9A, 9B, 10A and 10B are perspective views showing examples of first and second back leather portions 15*a* and 15*b*.

As shown in FIGS. 7 and 8, first and second back leather portions 15*a* and 15*b* have first and second folded portions 22*a* and 22*b*, respectively. Incision 3 is formed between these first and second folded portions 22*a* and 22*b*. A portion adjacent to first folded portion 22*a* in first back leather portion 15*a* and a portion 23*b* adjacent to second folded portion 22*b* in second back leather portion 15*b* are placed upon each other and sewed together.

A method of forming incision 3 according to the present invention Will be now described by referring to FIGS. 9A, 9B, 10A and 10B.

Figures 9A, 9B:
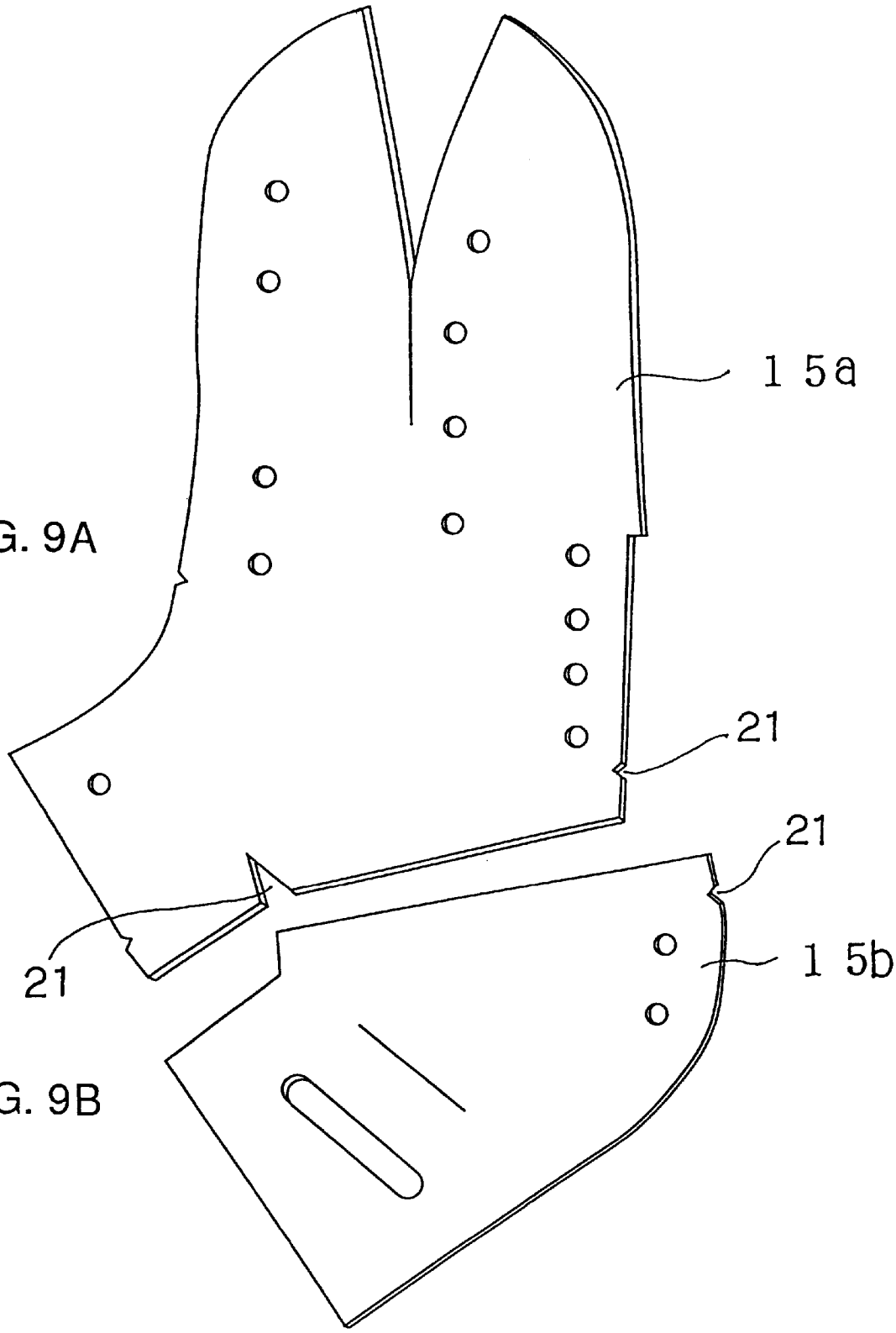
FIGS. 9A and 9B are perspective views showing an example of the first and second back leather portions according to the present invention.

First and second back leather portions 15*a* and 15*b* having the shapes shown in FIGS. 9A and 9B are formed. At this time, in the vicinity of respective one ends of first and second back leather portions 15*a* and 15*b*, notches 21 for forming first and second folded portions 22*a* and 22*b* are formed. In this case, notch 21 formed has a V shape.

Figures 10A, 10B:
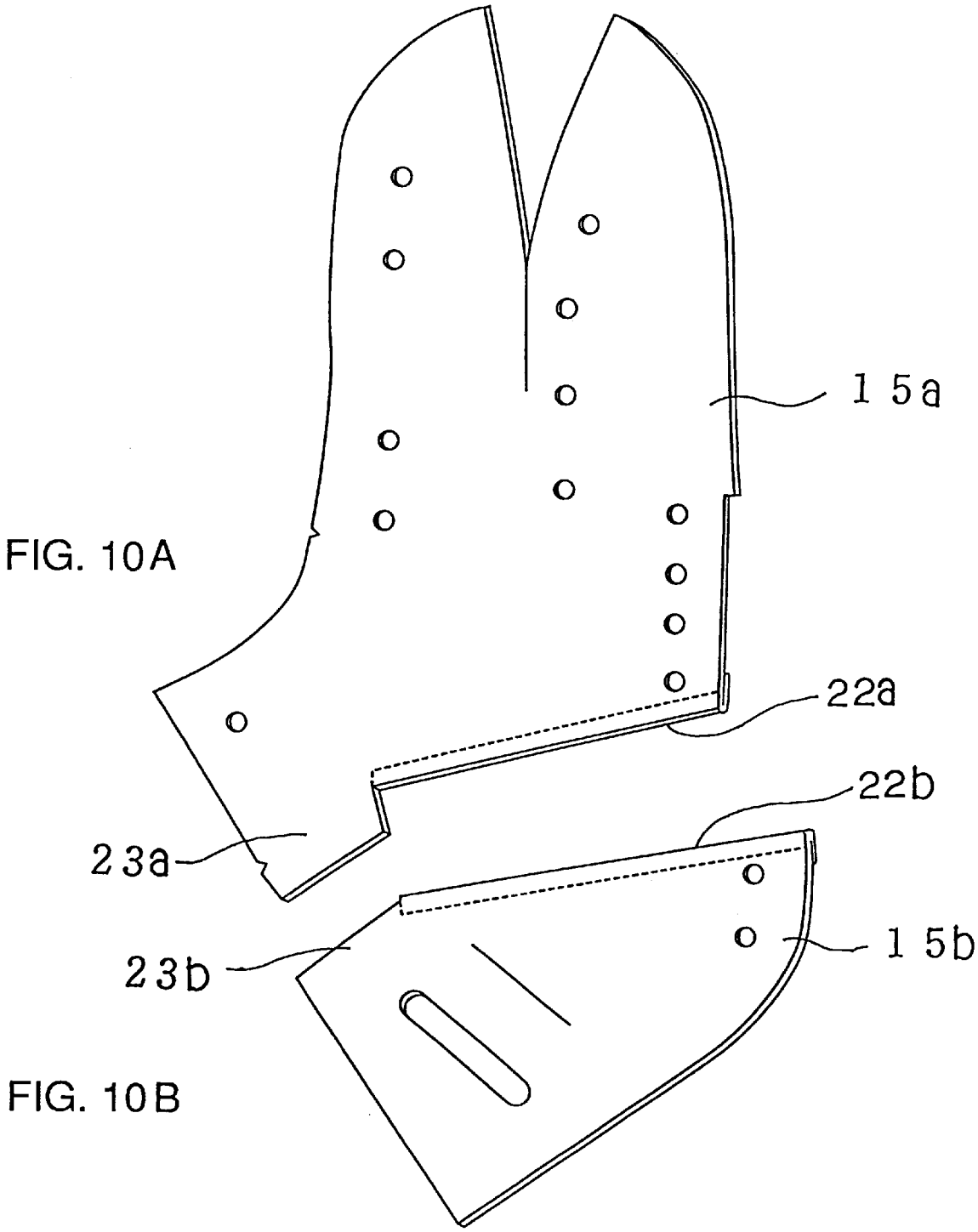
FIGS. 10A and 10B are perspective views showing how respective one ends of first and second back leather portions are folded.

As shown in FIGS. 10A and 10B, respective one ends of first and second back leather portions 15*a* and 15*b* are selectively folded and sewed to form first and second folded portions 22*a* and 22*b*. Thus, the above-described adjacent portion (protruding portion) 23*a* is formed at first back leather portion 15*a* in this case. This protruding portion may be formed on the side of second back leather portion 15*b*.

Thereafter, portion 23*b* adjacent to second folded portion 22*b* is placed on portion 23*a* (protruding portion) adjacent to first folded portion 22*a*. In this state, the portions thus placed upon one another are sewed together. Thus, incision 3 may be formed as sewed portion 28 is formed between first and second back leather portions 15*a* and 15*b*.

As described above, first and second back leather portions 15*a* and 15*b* are sewed together while adjacent portions 23*a* and 23*b* to first and second folded portions 22*a* and 22*b* are placed upon each other, so that the heights of first and second folded portions 22*a* and 22*b* can be different. In this case, since second back leather portion 15*b* is placed upon first back leather portion 15*a*, the height of second folded portion 22*b* may be slightly greater than the height of first folded portion 22*a*. Thus, a slight step may be formed at incision 3 from the start of use, thumb 6 is easily allowed to stick out on back leather 15 from incision 3.

Furthermore, first and second back leather portions 15*a* and 15*b* are placed upon each other and sewed together to improve the strength of the portions placed upon each other.

Note that the present invention is applicable to any type of baseball gloves such as catcher mitt and first mitt other than those shown in FIGS. 1 to 8 as long as the glove is a baseball catching implement to have a thumb stall.

According to the present invention, as the baseball glove can be closed with small force, a child with weak grip can surely catch a ball with the baseball glove. Since the thumb stopper like the conventional glove is not provided, a player will not feel uncomfortable because of disagreement between the stopper and the shape of the player's thumb. Furthermore, the glove can be manufactured without much work and the time and cost in the manufacture are not more than the case of conventional gloves.

Figure 11:
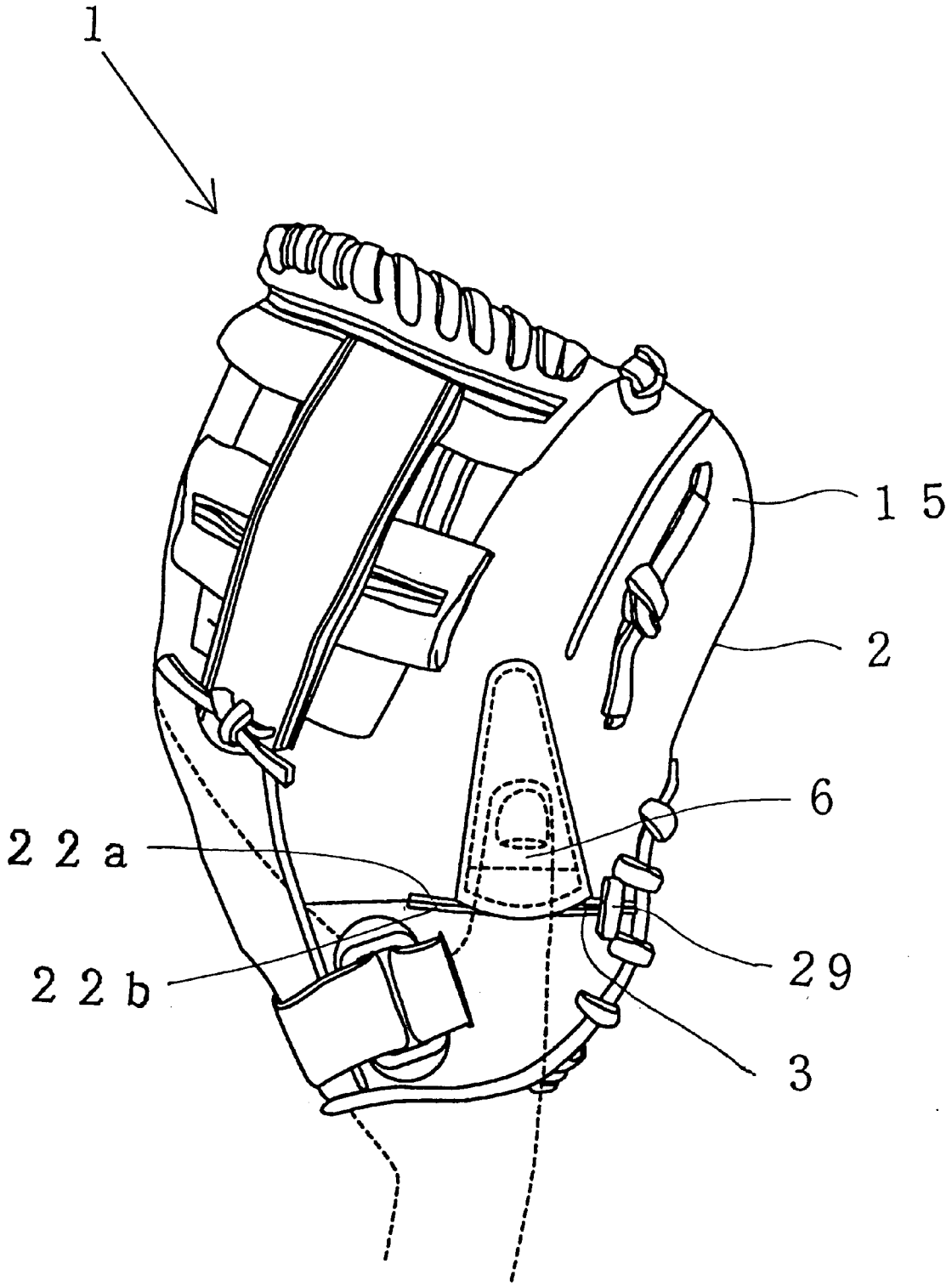
FIG. 11 is a front view of another embodiment of the present invention.

Referring to FIG. 11, yet another embodiment of the present invention will be now described. If a thumb is let out from a glove through incision 3 a number of times in use of the glove, the ends of incision 3 are subjected to load and could lip.

Therefore, as shown in FIG. 11, a leather string 29 extending in a direction crossing the direction in which incision 3 extends is attached in the vicinity of the outer end of incision 3. More specifically, string 29 is attached to back leather 15 so as to extend on first and second folded portions 22*a* and 22*b* which form incision 3, and this string 29 secures first and second folded portions 22*a* and 22*b*. Thus, the end of incision 3 can be restricted from ripping.

Note that the number or position of such strings 29 to be attached may be arbitrary as long as the end of incision 3 can be restricted from ripping. Alternatively, any member other than string 29 may be employed.

Figure 12:
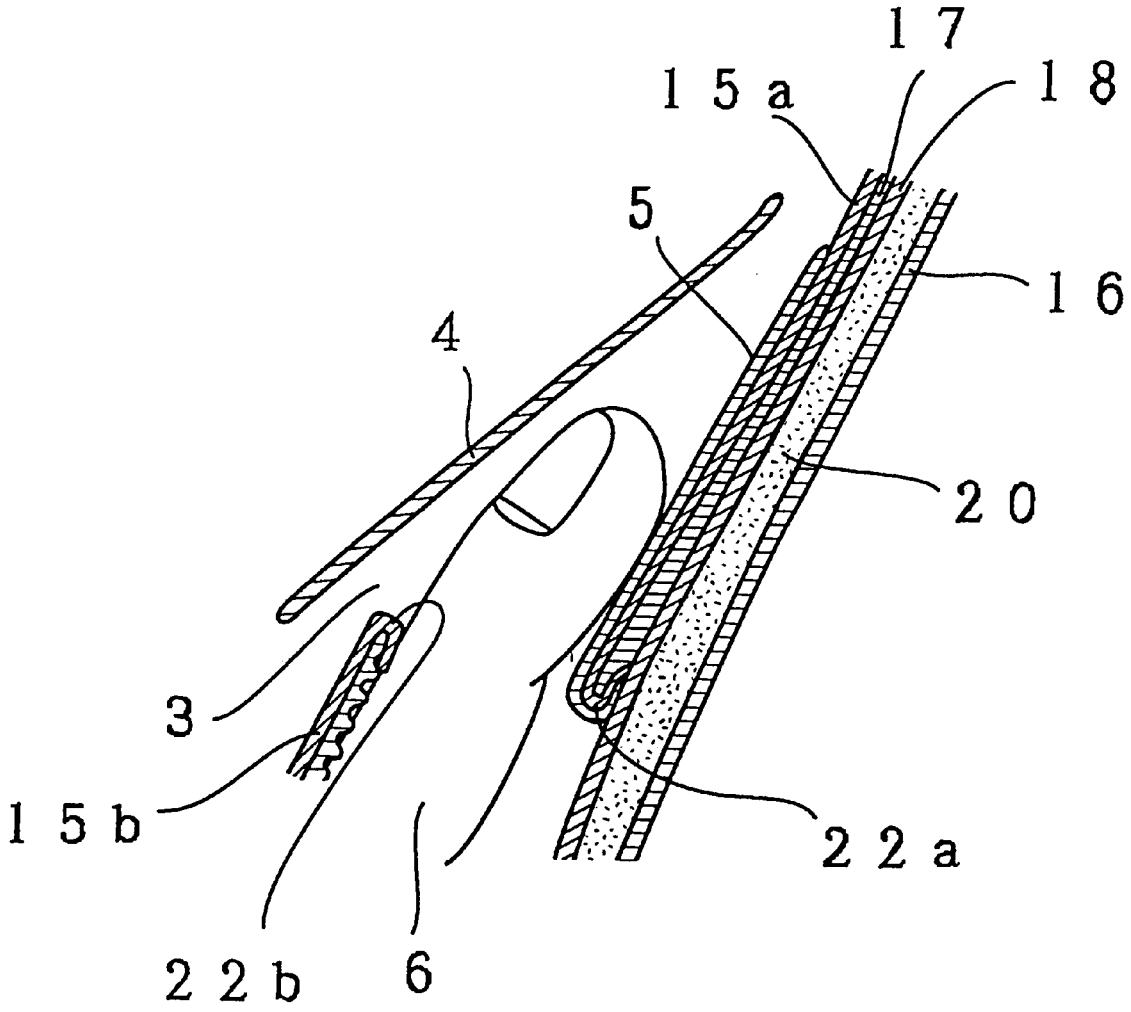
FIG. 12 is an expanded cross sectional view of the vicinity of an incision according to yet another embodiment of the present invention.

Referring to FIG. 12, yet another embodiment of the present invention will be now described.

When slip stopper member 5 is cut on first folded portion 22*a* and sewed to first back leather portion 15*a* according to the embodiment shown in FIG. 8, the following problem might arise. More specifically, if the user sticks out his thumb on slip stopper member 5 and touches the end of slip stopper member 5 a number of times, the end of slip stopper member 5 could peel off and turn from first back leather portion 15*a*.

Hence, as shown in FIG. 12, the end of slip stopper member 5 positioned on the side of incision 3 is folded, placed on first folded portion 22*a* and sewed together. Thus, the thumb can be prevented from touching the end of slip stopper member 5, so that the peeling of slip stopper member 5 can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baseball glove having a thumb stall, comprising an incision provided at a back leather of said thumb stall for allowing the tip portion of a thumb to stick out on said back leather and allowing the knuckle of said thumb to be covered with said back leather.

2. The baseball glove according to claim 1, wherein a portion closer to the knuckle side than the first joint of the thumb is covered with said back leather.

3. The baseball glove according to,claim 1, wherein the length of said incision is at least the width of a central portion along the lengthwise direction of said thumb stall and at most the maximum width of said thumb stall.

4. The baseball glove according to claim 1, wherein said incision extends from an outer end of said thumb stall to an inner side of said glove.

5. The baseball glove according to claim 1, wherein a thumb protecting member to cover said tip portion sticking out on said back leather is attached on said back leather.

6. The baseball glove according to claim 5, wherein the length of said incision is greater than the maximum width of said thumb protecting member.

7. The baseball glove according to claim 5, ,herein said thumb protecting member is provided closer to the inner side of said glove with respect to a central line along the lengthwise direction of said thumb stall.

8. The baseball glove according to claim 7, further comprising a web portion on the inner side of said glove with respect to said thumb stall, wherein a tip end of said thumb protecting member along the lengthwise direction is positioned on the inner side with respect to the central line of said thumb stall, and said thumb protecting member extends in a direction oblique relative to the central line of said thumb stall by a prescribed angle toward a side of said web portion.

9. The baseball glove according to claim 5, wherein the tip end of said thumb protecting member is released from said back leather.

10. The baseball glove according to claim 5, wherein an end of said thumb protecting member covers said incision.

11. The baseball glove according to claim 5, wherein a space to receive said tip portion with said tip portion being capable of moving freely is formed by said back leather and said thumb protecting member.

12. The baseball glove according to claim 1, wherein a slip stopper member is attached on a part of said back leather upon which the palm side of the thumb sticking out from said incision abuts.

13. The baseball glove according to claim 12, wherein said slip stopper member is formed of one of embossed artificial leather and synthetic leather.

14. The baseball glove according to claim 12, wherein an end of said slip stopper member on the side of said incision is secured to said back leather in a folded state so as to cover a part of the end of said back leather forming said incision.

15. The baseball glove according to claim 1, comprising a hand inserting portion to insert a hand into said baseball glove, wherein the back leather of said thumb stall includes a first back leather portion positioned closer to the tip end side of said thumb stall with respect to said incision and a second back leather portion positioned closer to said hand inserting portion with respect to said incision, said first and second back leather portions have first and second folded portions, respectively, said incision is formed between said first and second folded portions, and portions adjacent to said first and second folded portions in said first and second back leather portions are placed upon with each other and sewed together.

16. The baseball glove according to claim 1, wherein a member extending over said incision in a direction crossing the direction in which said incision extends to restrict an end of said incision from ripping is provided on said back leather.

* * * * *